US006241357B1

(12) United States Patent
Lee

(10) Patent No.: US 6,241,357 B1
(45) Date of Patent: Jun. 5, 2001

(54) MIRROR/COMB ASSEMBLY

(76) Inventor: Ya-Chung Lee, 12F, No.42, Lane 3, Li Te 8$^{th}$ Rd., Tainan (TW)

( * ) Notice: Subject to any disclaimer, the term of this patent is extended or adjusted under 35 U.S.C. 154(b) by 0 days.

(21) Appl. No.: 09/695,260

(22) Filed: Oct. 25, 2000

(51) Int. Cl.$^{7}$ ..... G02B 7/182
(52) U.S. Cl. ..... 359/879; 359/880; 359/872
(58) Field of Search ..... 359/879, 880, 359/872; 248/473, 474, 496, 497; 132/45 R, 79, 102, 83, 85

(56) References Cited

U.S. PATENT DOCUMENTS 1,179,063 * 4/1916 Aldrete .
3,411,842 * 11/1968 Levy .
3,942,540 * 3/1976 Gause ..... 132/79
4,401,129 * 8/1983 Luque ..... 132/45 R
5,386,322 * 1/1995 Parsons ..... 359/872
6,099,133 * 8/2000 Wright ..... 359/880

* cited by examiner

*Primary Examiner*—Mohammad Sikder
(74) *Attorney, Agent, or Firm*—Charles E. Baxley

(57) ABSTRACT

A mirror/comb assembly includes a base, a mirror frame mounted to the base, a mirror, and at least one comb. The mirror is securely held by an inner periphery of the mirror frame. At least one comb-receiving portion is defined in an outer periphery of the mirror frame for releasably receiving the comb mirror frame is rotatably connected to the base. The comb-receiving portion is preferably a groove and includes an engaging portion, and the comb has an engaging portion for releasably engaging with the engaging portion of the comb-receiving portion. The comb-receiving portion includes a notch to allow easy removal of the comb.

7 Claims, 7 Drawing Sheets

MIRROR/COMB ASSEMBLY

BACKGROUND OF THE INVENTION

1. Field of the Invention

The present invention relates to a mirror/comb assembly, and more particularly to a mirror having at least one comb releasably attached thereto.

2. Description of the Related Art

FIG. 7 of the drawings illustrates a conventional desktop mirror 1' having a base 13' so as to be placed onto a flat surface, such as a desktop. A mirror 11' is held by an inner peripheral channel 121' of an outer frame 12', which, in turn, includes two pointless 122' that are rotatably engaged with pivotal holes 131' of the base 13'. Combs are often required when using the desktop mirror 1' for combing hair. As a result, the user must prepare combs and the combs will occupy a certain space on the desktop and thus cause an aesthetically pleasing effect.

SUMMARY OF THE INVENTION

It is the primary object of the present invention to provide a mirror/comb assembly, wherein at least one comb is releasably attached to an outer periphery of a mirror frame that is mounted around a mirror.

A mirror/comb assembly in accordance with the present invention comprises:

a base;

a mirror frame mounted to the base and including an inner periphery and an outer periphery, at least one comb-receiving portion being defined in the outer periphery of the mirror frame;

a mirror securely held by the inner periphery of the mirror frame; and at least one comb releasably received in said at least one comb-receiving portion of the mirror frame.

The mirror frame is rotatably connected to the base. The comb-receiving portion is preferably a groove and includes an engaging portion, and the comb has an engaging portion for releasably engaging with the engaging portion of the comb-receiving portion. The comb-receiving portion includes a notch to allow easy removal of the comb. The comb-receiving portion includes at least one engaging hole, and wherein the comb includes at least one knurl for releasably engaging with the engaging hole. The comb may include has at least one decorative member or pattern.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
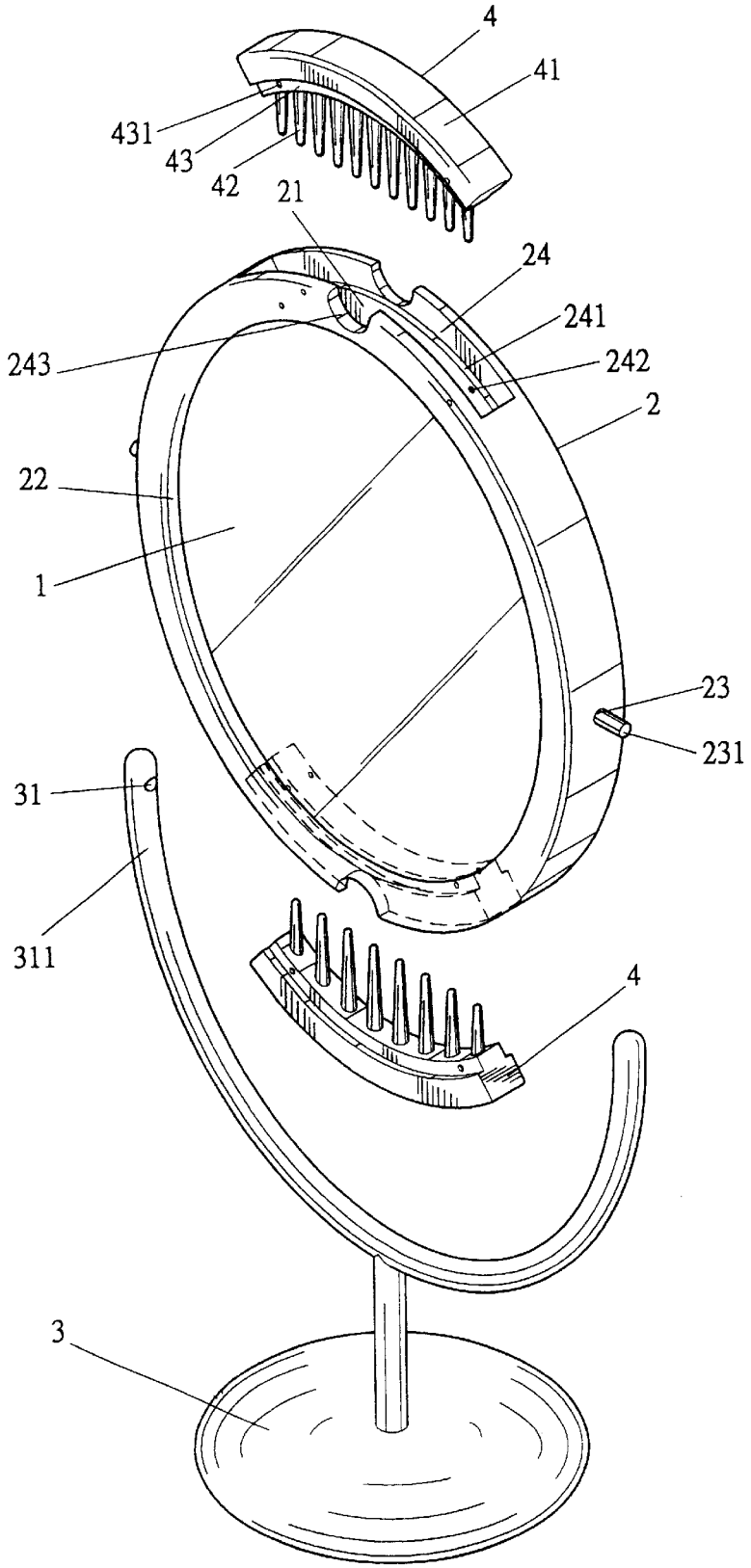
FIG. 1 is an exploded perspective view of a mirror/comb assembly in accordance with the present invention.
Figure 2:
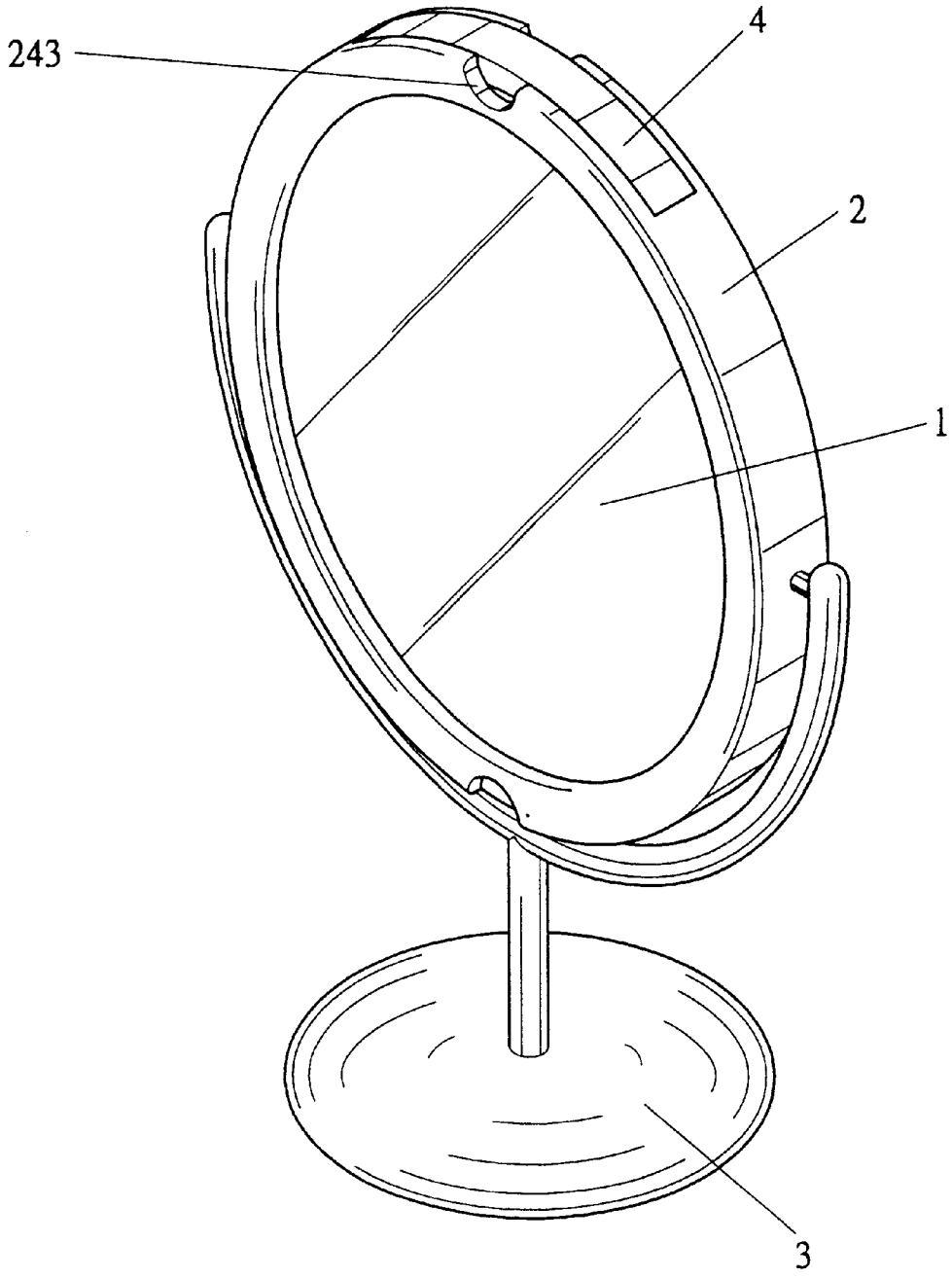
FIG. 2 is a perspective view of the mirror/comb assembly in accordance with the present invention.

Referring to FIGS. 1 through 6 and initially to FIGS. 1 and 2, a mirror/comb assembly in accordance with the present invention generally includes a base 3 having a substantially semi-circular portion 311, a mirror frame 2 rotatably attached to the semi-circular portion 311 of the base 3, a mirror 1 securely held in the mirror frame 2, and at least one comb 4 releasably attached to an outer periphery of the mirror frame 2.

In this embodiment, the outer periphery of the mirror frame 2 includes two opposite pivotal portions 23 in the form of pintles 231 so as to be pivotally engaged with pivotal holes 31 in the semi-circular portion 311 of the base 3. The mirror frame 2 includes an inner peripheral channel 22 for securely holding the mirror 1 in place. In addition, two comb-receiving portions 24 (in the form of grooves) are defined in the outer periphery of the mirror frame 2 for receiving two combs 4 of identical or different shapes and sizes.

Each comb-receiving portion 24 includes an engaging portion 241 with at least one engaging hole 242. The comb 4 includes a grasp portion 41 having a plurality of teeth 42 projected therefrom, and an engaging portion 43 for releasably engaging with the engaging portion 241 of the associated comb-receiving portion 24. Each engaging portion 42 further includes at least one knurl 43 for releasably engaging with the engaging hole 242 of the associated comb-receiving portion 24.

Figure 3:
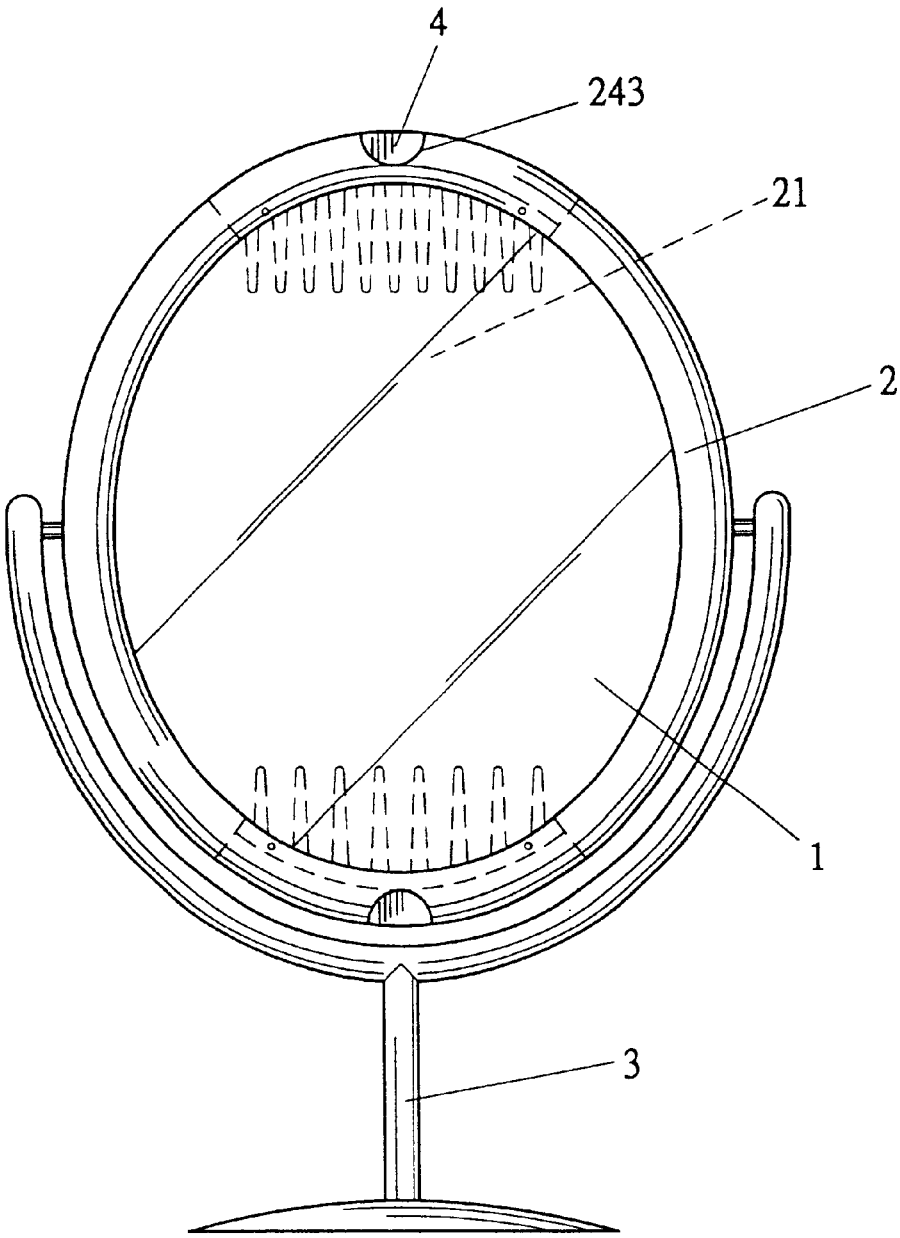
FIG. 3 is a front view of the mirror/comb assembly in accordance with the present invention.
Figure 4:
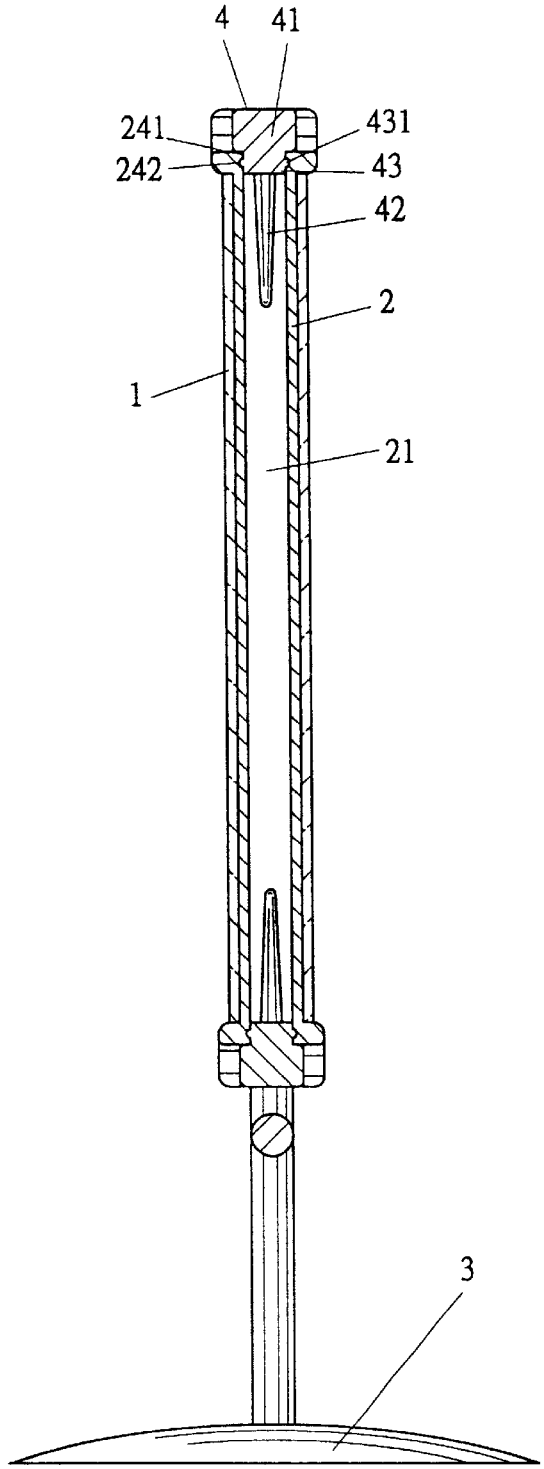
FIG. 4 is a sectional view of the mirror/comb assembly in accordance with the present invention.
Figure 5:
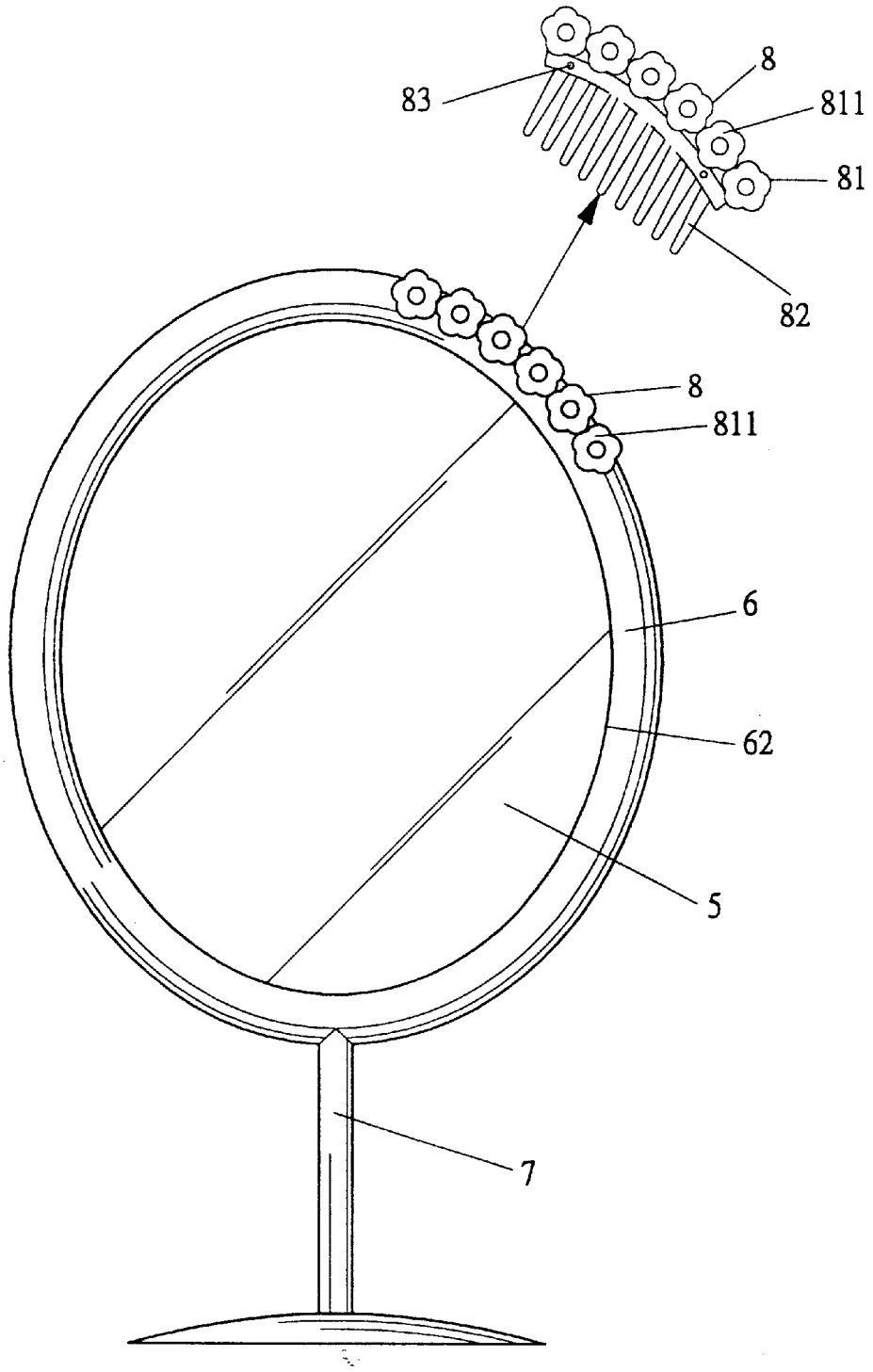
FIG. 5 is a front view of another embodiment of the mirror/comb assembly in accordance with the present invention.
Figure 6:
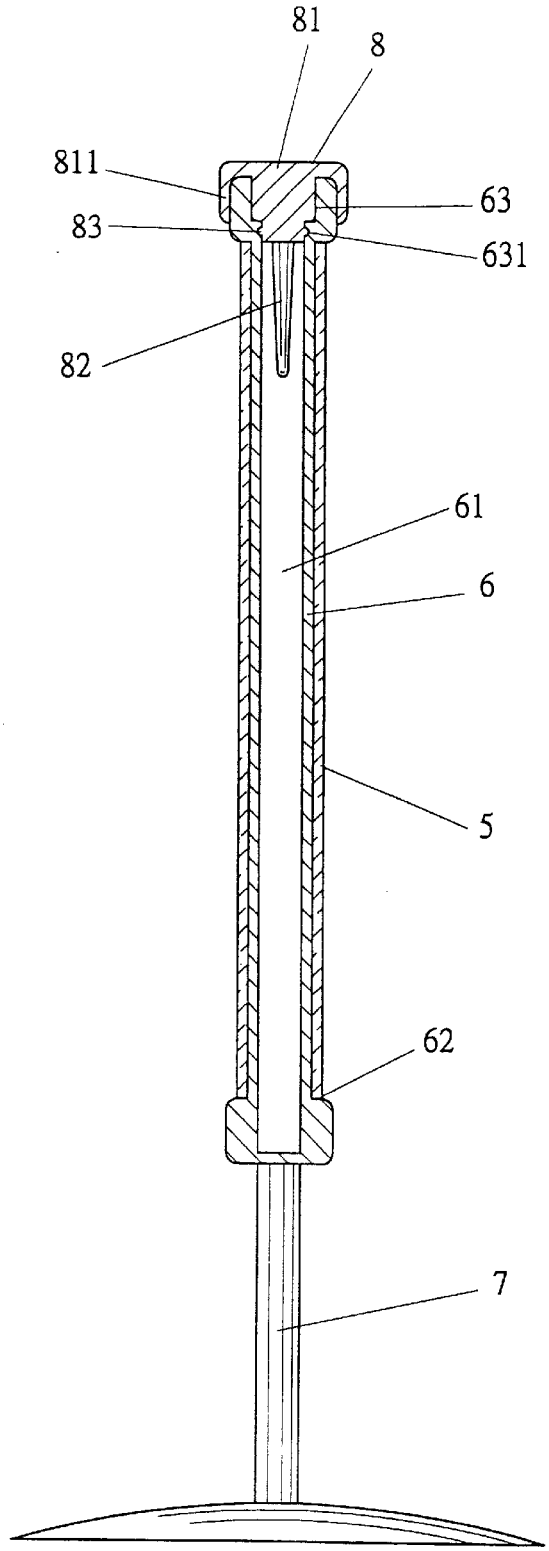
FIG. 6 is a sectional view of the mirror/comb assembly in FIG. 5.

In assembly, as illustrated in FIGS. 2 through 4, the teeth 42 of each comb 4 are received in the associated comb-receiving portion 24 with the engaging portion 43 engaged with the engaging portion 241 and with the knurls 431 engaged with the engaging holes 242. An aesthetically pleasing effect is provided by mounting the combs 4 onto the outer periphery of the mirror frame 2. Compared to conventional designs, a neat, larger space is provided when the mirror/comb assembly is placed onto a desktop. In addition, the combs 4 are readily available to the user. At least one of two lateral walls defining the comb-receiving portion 24 includes a notch 243 to allow easy removal of the comb 4.

Figure 7:
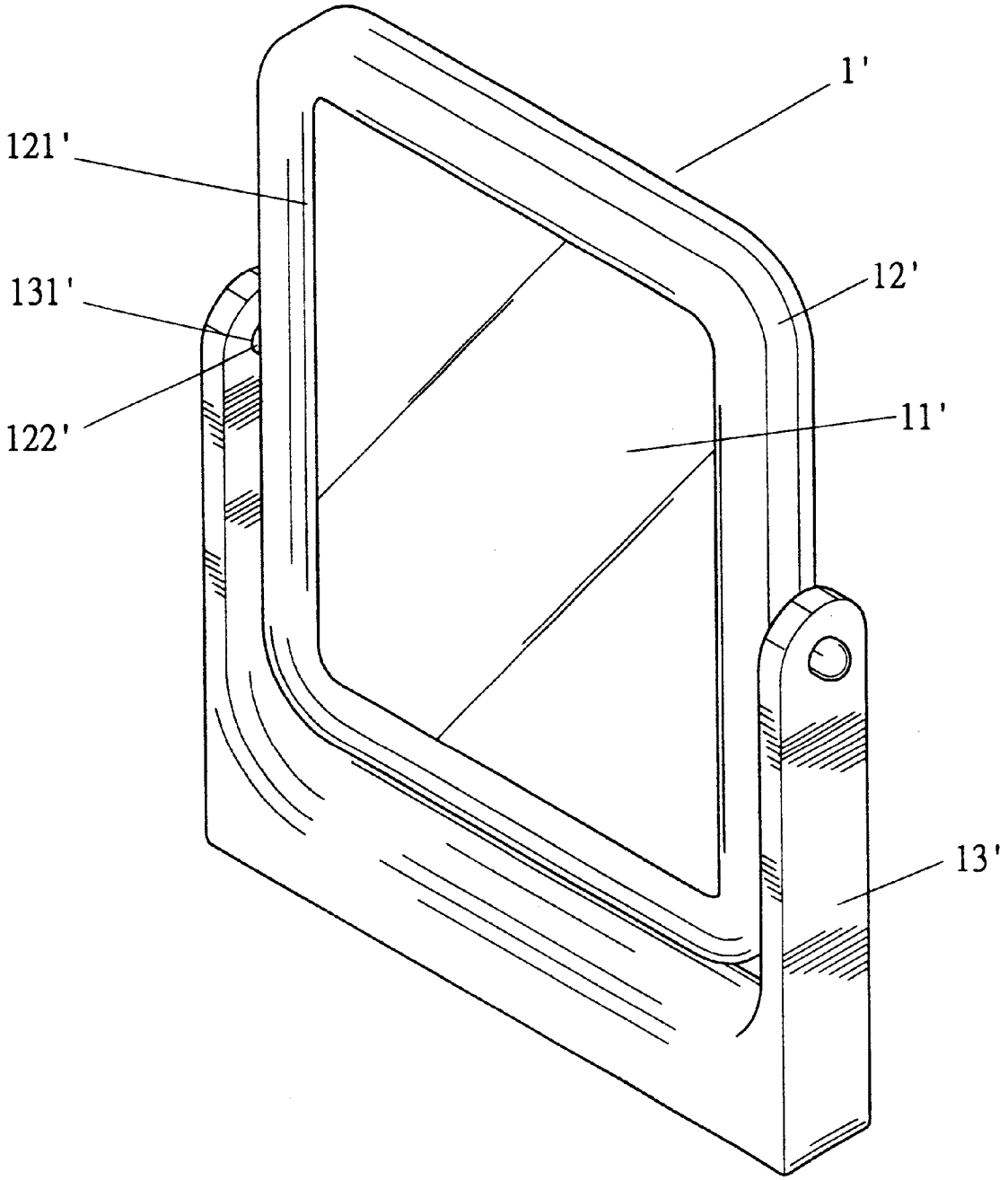
F I G . 7 (PRIOR ART)
FIG. 7 is a perspective view of a conventional desktop mirror.

FIGS. 7 and 8 illustrate another embodiment of the invention, wherein the mirror/comb assembly comprises a base 7, a mirror frame 6, a mirror 5 held in an inner peripheral channel 62 of the mirror frame 6, and a comb 8 releasably mounted in a comb-receiving portion 63 (in the form of a groove) defined in an outer periphery of the mirror frame 6. The comb 8 includes a grasp portion 81 with a plurality of teeth 82 projected therefrom, and an engaging portion 83 for releasable engagement with an engaging portion 631 of the comb-receiving portion 63. The grasp portion 81 of the comb 8 may include decorative members 81.

In assembly, the teeth 82 of the comb 8 are received in the comb-receiving portion 63 with the engaging portion 83 engaged with the engaging portion 631. Of course, the comb 8 may include knurls (not labeled) for engaging with engaging holes (not labeled) in the engaging portion 631 of the comb-receiving portion 63. An aesthetically pleasing effect is provided by mounting the comb 8 onto the outer periphery of the mirror frame 6. The mirror frame 6 may be used with any one of various combs 8 having different decorative members 81 or decorative patterns.

Although the invention has been explained in relation to its preferred embodiment, it is to be understood that many other possible modifications and variations can be made without departing from the scope of the invention as hereinafter claimed.

What is claimed is:

1. A mirror and comb assembly comprising:

a base;

a mirror frame mounted to the base and including an inner periphery and an outer periphery, at least one comb-receiving portion being defined in the outer periphery of the mirror frame;

a mirror securely held by the inner periphery of the mirror frame; and at least one comb releasably received in said at least one comb-receiving portion of the mirror frame.

2. The mirror and comb assembly as claimed in claim 1, wherein the mirror frame is rotatably connected to the base.

3. The mirror and comb assembly as claimed in claim 1, wherein said at least one comb-receiving portion includes an engaging portion, and wherein said at least one comb has an engaging portion for releasably engaging with the engaging portion of said at least one comb-receiving portion.

4. The mirror and comb assembly as claimed in claim 1, wherein said at least one comb-receiving portion includes a notch to allow easy removal of said at least one comb.

5. The mirror and comb assembly as claimed in claim 1, wherein said at least one comb-receiving portion is a groove.

6. The mirror and comb assembly as claimed in claim 5, wherein said at least one comb-receiving portion includes at least one engaging hole, and wherein said at least one comb includes at least one knurl for releasably engaging with said at least one engaging hole.

7. The mirror and comb assembly as claimed in claim 1, wherein said at least one comb has at least one decorative member.

* * * * *